United States Patent [19]

Ricketts et al.

[11] 4,333,684

[45] Jun. 8, 1982

[54] METHOD OF UNIFORM RUBBLIZATION FOR LIMITED VOID VOLUME BLASTING

[75] Inventors: Thomas E. Ricketts, Grand Junction, Colo.; Bruce B. Redpath, Murphys, Calif.

[73] Assignee: Occidental Oil Shale Inc., Grand Junction, Colo.

[21] Appl. No.: 193,119

[22] Filed: Oct. 2, 1980

Related U.S. Application Data

[63] Continuation-in-part of Ser. No. 88,370, Oct. 26, 1979, abandoned.

[51] Int. Cl.[3] ..... E21B 43/247; E21B 43/263; E21C 41/10

[52] U.S. Cl. ..... 299/2; 102/312; 166/259; 299/3

[58] Field of Search ..... 102/311, 313; 166/259, 166/299; 299/2, 13

[56] References Cited

U.S. PATENT DOCUMENTS

| | | | |
|---|---|---|---|
| 2,708,876 | 5/1955 | Nowak | 102/313 X |
| 3,466,094 | 9/1969 | Haworth et al. | 299/13 |
| 3,593,793 | 7/1971 | Kelseaux | 166/299 X |
| 3,661,423 | 5/1972 | Garrett | 299/13 X |
| 4,043,595 | 8/1977 | French | 299/2 |
| 4,043,596 | 8/1977 | Ridley | 299/2 |
| 4,118,071 | 10/1978 | Hutchins | 299/2 |
| 4,135,450 | 1/1979 | Lang | 299/13 |
| 4,148,529 | 4/1979 | Burton | 299/2 |
| 4,167,291 | 9/1979 | Ridley | 299/2 |

FOREIGN PATENT DOCUMENTS

| | | | |
|---|---|---|---|
| 44475 | 5/1961 | Poland | 299/13 |

*Primary Examiner*—Stephen J. Novosad
*Assistant Examiner*—George A. Suchfield
*Attorney, Agent, or Firm*—Christie, Parker & Hale

[57] ABSTRACT

There is provided a method of forming an in situ oil shale retort in a retort site within a subterranean formation containing oil shale. The in situ oil shale retort contains a fragmented permeable mass of formation particles. A first portion of formation is excavated from within the boundaries of the retort being formed to form at least one void. The surface of the formation defining such a void provides at least one free face extending through the formation. The second portion of formation is left within the boundaries of the retort being formed to be explosively expanded toward the void.

At least two arrays of explosive charges are formed in the second portion of formation wherein the first array of explosive charges has a first burden distance and the second array of explosive charges has a second burden distance wherein the second burden distance is less than the first burden distance. Explosive is detonated for explosively expanding the second portion of formation toward the void to form a fragmented permeable mass of formation particles containing oil shale in the subterranean formation for forming an in situ oil shale retort.

81 Claims, 6 Drawing Figures

METHOD OF UNIFORM RUBBLIZATION FOR LIMITED VOID VOLUME BLASTING

CROSS-REFERENCE TO RELATED APPLICATIONS

This application is a Continuation-in-Part of Ser. No. 088,370 filed Oct. 26, 1979, now abandoned, which is incorporated herein by this reference.

BACKGROUND OF THE INVENTION

This invention relates to the recovery of liquid and gaseous products from an in situ oil shale retort in a subterranean formation.

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil as described in U.S. Pat. No. 3,661,423 includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated, preferably in a single round, to explosively expand each unfragmented zone into the voids to form a fragmented mass. Retorting of the fragmented mass is then carried out to recover shale oil from the oil shale.

U.S. Pat. No. 4,043,596 discloses a method of forming an in situ oil shale retort in a subterranean oil shale deposit by excavating at least one vertically extending columnar void. The surface of the formation which defines the columnar void presents at least one free face which extends vertically through the subterranean oil shale deposit. A portion of the formation within the boundary of the in situ retort to be formed and which extends away from the free face is explosively expanded toward the columnar void in one or more segments. The expansion of the oil shale toward the columnar void fragments the oil shale, thereby distributing the void volume of the columnar void throughout the retort.

It is desirable to form an in situ retort with a generally uniformly distributed void fraction having a fragmented mass of generally uniform permeability so that oxygen-supplying gas can flow relatively uniformly through the fragmented mass during retorting operations. Techniques used for explosively expanding zones of unfragmented formation toward a free face of formation adjacent a void can control the uniformity of particle size and permeability of the fragmented mass. A fragmented mass having generally uniform permeability in horizontal planes across the fragmented mass avoids bypassing portions of the fragmented mass by retorting gas.

In blasting to a vertical void, a present method is to drill rows of substantially vertical blastholes in the formation to be expanded wherein the blastholes are substantially equal in diameter and each row has about the same burden distance. Burden distance as used herein is the substantially perpendicular distance from the center of mass of an explosive charge in such a row to the free face toward which the unfragmented formation is being expanded.

One of the problems of using a blast design with equal size blastholes spaced in rows having about equal burden distance for blasting to a void is the formation of a fragmented mass having an unevenly distributed void fraction. The uneven distribution is caused by the decreasing volume of void space that is available for expansion of each subsequent layer of rock as the blast proceeds away from the initial free face. This method results in maximum void fraction in the region of the vertical void and less void fraction, i.e., tighter rubblization, in the outer portions of the retort away from the vertical void.

Having a retort with a gradient of void fraction across the horizontal cross-section of the fragmented permeable mass of oil shale particles can cause gas channeling, bypassing of oil shale by the retorting zone, and a resultant reduction in yield of gaseous and liquid products from the retort.

SUMMARY OF THE INVENTION

A method is provided for recovering liquid and gaseous products from an in situ oil shale retort in a subterranean formation containing oil shale. A first portion of the formation is excavated from within the boundaries of the retort being formed to form at least one void. The surface of the formation defining such a void provides at least one free face extending through the oil shale formation within the boundaries of the retort being formed. A second portion of the formation is left to be explosively expanded toward such a void. The second portion of formation is within the boundaries of the retort being formed and extends away from such a free face.

At least two arrays of explosive charges are formed in such a second portion of formation wherein the first array of explosive charges has a first burden distance and the second array of explosive charges has a second burden distance. The second burden distance is less than the first burden distance and the equivalent scaled point charge depth of burial of the first array of explosive charges is substantially equal to the equivalent scaled point charge depth of burial of the second array of explosive charges. Explosive is detonated for explosively expanding such a second portion of formation toward such a void to form a fragmented mass of formation particles containing oil shale in the subterranean formation for forming an in situ oil shale retort.

Gas is introduced into the fragmented permeable mass in the in situ oil shale retort for establishing and advancing a retorting zone in the fragmented mass. Oil shale is retorted to produce gaseous and liquid products and the gaseous and liquid products are withdrawn from the retort.

DRAWINGS

These and other features, aspects, and advantages of the present invention will become more apparent when considered with respect to the following description, appended claims, and accompanying drawings wherein:

DETAILED DESCRIPTION

Figure 1:
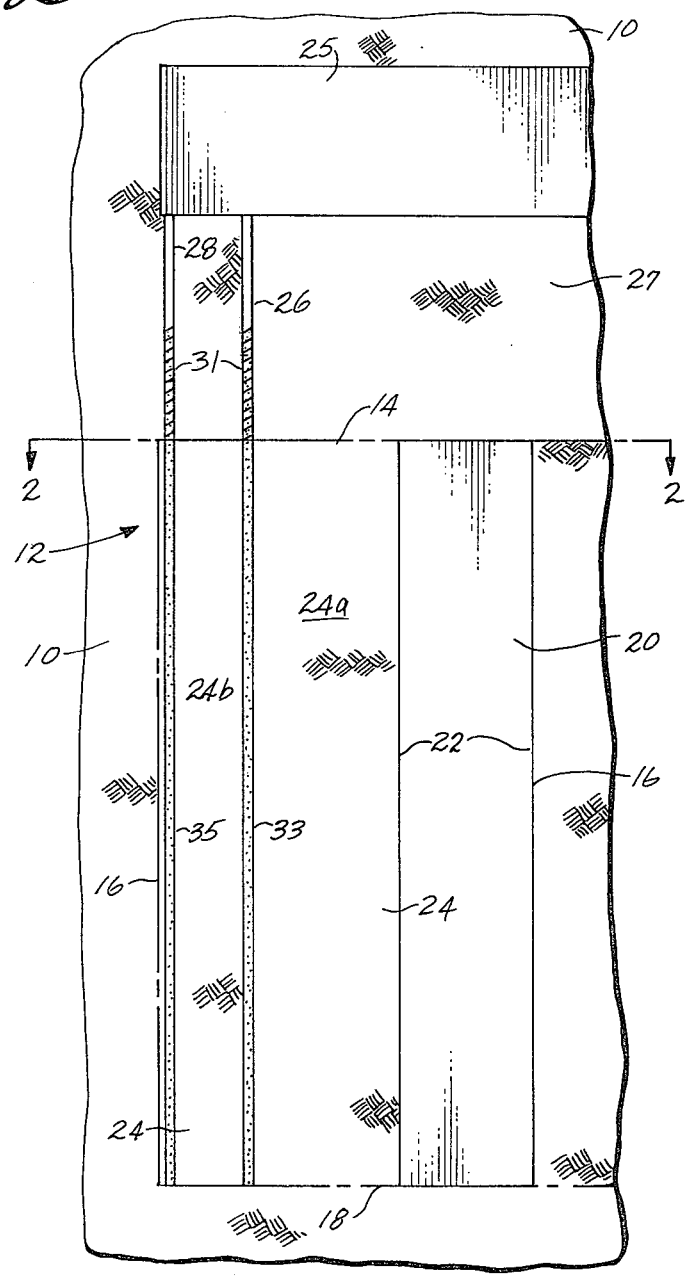
FIG. 1 is a semi-schematic vertical cross-sectional view of an in situ oil shale retort being formed using a vertical void system.
Figure 2:
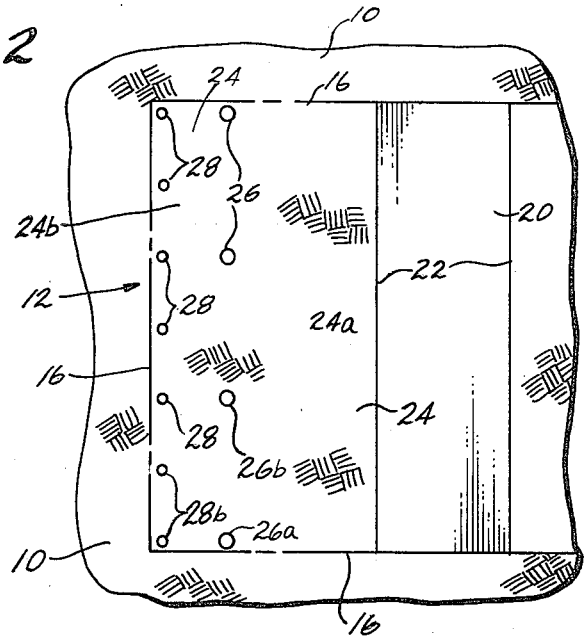
FIG. 2 is a semi-schematic horizontal cross-sectional view of the retort being formed taken on line 2—2 of FIG. 1 and having a first arrangement of blastholes.

This invention relates to a method for expanding formation toward a void formed in a subterranean formation. More particularly, this invention relates to the formation of an in situ oil shale retort in a retort site within a subterranean formation. The in situ oil shale retort is formed containing a fragmented permeable mass of formation particles having a reasonably uniformly distributed void fraction Principles of this invention can be understood by referring to FIGS. 1 and 2. FIG. 1 is a semi-schematic vertical cross-sectional view of a subterranean formation 10 partially prepared for formation of an in situ oil shale retort 12. FIG. 2 is a semi-schematic horizontal cross-sectional view taken on line 2—2 of FIG. 1.

In an exemplary embodiment shown in FIGS. 1 and 2, a first portion of formation is excavated from within a top boundary 14, side boundaries 16, and bottom boundary 18 of the retort being formed to form at least one vertically extending void 20. Preferably, the void 20 is a "limited void" with respect to the volume of formation to be expanded toward the void. If desired, however, the void need not be a limited void and additionally can be other than vertical. For example, a horizontal void can be used in practice of principles of this invention, as is described in greater detail below.

A "limited void" as used herein is defined as a void which has less available volume than would be required for free expansion of formation toward the void.

When an earth formation is explosively fragmented and expanded, it increases in bulk due to the void space in interstices between the particles. The maximum expansion of oil shale formation into an unlimited void results in a fragmented mass having an average void fraction of about 35 percent; that is, about 35 percent of the total volume occupied by the fragmented mass is void space between the particles. The volume occupied by the fragmented mass is about 55 percent larger than the volume occupied by the original unfragmented formation after such unlimited or free expansion. This is sometimes referred to as a bulking factor of 55 percent.

A "limited void" is one where the void space available for explosive expansion is less than needed for free bulking of the formation expanded toward the void. Thus, if a void has an excavated volume less than about 35 percent of the total of the volume of the void plus the volume of formation which is occupied by formation explosively expanded into the void, it is necessarily a limited void. It has been found that factors in addition to total available void can make a void "limited" even though the total available void may appear sufficient for free bulking. Thus, the fragmented mass formed by explosive expansion may not expand to completely fill available void space and the average void fraction of the fragmented mass may be less than projected from the available void space.

Figure 6:
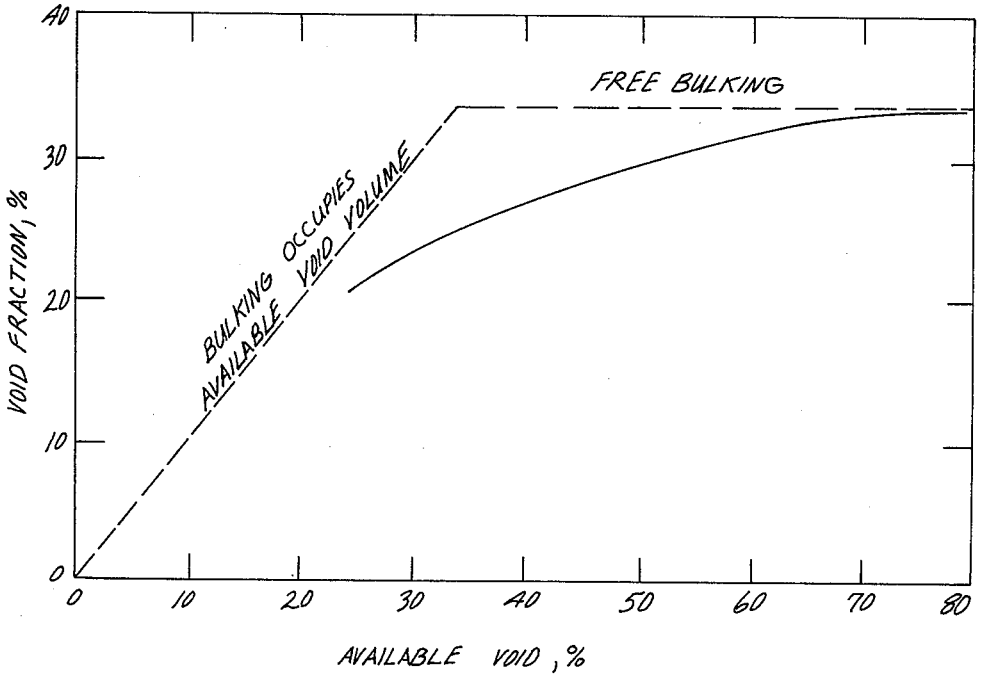
FIG. 6 is a graph of void fraction in a fragmented mass as a function of available void.

FIG. 6 is a graph of a void fraction (in percent) in a fragmented mass as a function of the available void, also stated as a percentage. The available void is the percentage of the volume of an excavated void relative to the total volume of the excavated void plus the volume occupied by formation expanded toward that void.

One would expect the void fraction in a fragmented mass to equal the available void up to a void fraction corresponding to free bulking. Once the free bulking void fraction is reached, there should be no increase in void fraction with increasing available void. Thus, if the available void were 28 percent, for example, one would expect the void fraction in a fragmented mass to be 28 percent. If the available void were 40 percent, the void fraction would be expected to be 35 percent. This expectation is indicated by the dashed line in FIG. 6 which increases with the slope of 1 up to about 35 percent and above a void fraction of about 35 percent, there is no increase regardless of increasing available void.

It has been found, however, that the actual void fraction in a fragmented mass is less than the available void up to available voids substantially above 35 percent. Thus, for example, with an available void of about 28 percent, the average void fraction in the fragmented mass was only about 23 percent. Similarly, with an available void of about 55 percent, the fragmented mass void fraction was only about 31 percent. Such an experimentally determined relation is illustrated by the solid line in FIG. 6.

It is believed that an excavated void can behave as a limited void, i.e., be considered a limited void for purposes herein, even though the available void is larger than required for free bulking because of interaction of particles during explosive expansion with adjacent walls of unfragmented formation. The same effect can occur when expanding formation collides with formation expanding from another direction, such as when zones on both sides of a void are expanded toward the void.

Referring again to FIGS. 1 and 2, a free face 22 provided extends vertically through the oil shale formation and between the top, bottom, and side boundaries of the retort 12 being formed. A second portion 24 of the formation is left within the boundaries of the retort being formed and extends away from the free face 22. The second portion 24 of formation is to be explosively expanded toward the vertically extending void 20.

Although one vertically extending void such as the void 20 is used for forming the in situ oil shale retort of the exemplary embodiment, it should be understood that more than one vertically extending void can be used if desired.

The void or voids excavated in a subterranean formation for forming an in situ oil shale retort can comprise greater than about 15 percent and preferably from about 15 percent to about 45 percent of the total volume within the boundaries of the retort being formed. When the fragmented permeable mass has a void fraction much less than about 15 percent, it has a low permeability, resulting in high pressure differential needed for gas flow through the retort. Additionally, when the void fraction of a fragmented mass is less than about 15 percent, non-uniformity of void fraction distribution can cause significant gas flow maldistribution.

Economic considerations are the principal reasons why the void(s) excavated comprise preferably less than about 45 percent of the total volume within the boundaries of the retort being formed. For example, having a void(s) comprise more than about 45 percent of the total volume within the boundaries of the retort results in excess cost of mining and additionally retorting less oil shale in situ.

Additional details of forming a vertical void within a subterranean formation can be found in U.S. Pat. No. 4,043,595 by Gordon B. French and in U.S. Pat. No. 4,043,596 by Richard D. Ridley. Both U.S. Pat. No. 4,043,595 and U.S. Pat. No. 4,043,596 are incorporated hereinabove by reference.

Additionally, formation can be excavated to form a base of operation 25 for providing access across substantially the entire horizontal cross-section of the in situ oil shale retort 12 being formed. The base of operation can be used during formation of a retort, facilitates ignition over a top portion of a fragmented permeable mass of formation particles, facilitates control of introduction of oxygen-supplying gas into the retort, provides a location for testing properties of the fragmented mass such as distribution of void fraction, and provides a location for evaluating performance of the retort during operation.

In the exemplary embodiment, an array of spaced apart vertical blastholes is formed in the second portion 24 of formation adjacent the free face 22. The array of blastholes comprises at least two rows of blastholes wherein each row extends substantially parallel to such a free face.

The blastholes can be drilled from the base of operation 25 downwardly through a zone of unfragmented formation below the base of operation and through the second portion 24 of formation to be explosively expanded. The zone of unfragmented formation below the base of operation is termed a "sill pillar" and can remain after the formation of the in situ oil shale retort to provide a barrier between the retort and the base of operation 25. The sill pillar 27 prevents gas and heat generated during the retorting operation from entering the base of operation.

Alternatively, when no base of operation is provided, the blastholes can be drilled from the ground surface or can be drilled from drifts adjacent the retort site.

Where the void provided is a vertically extending void as is the void 20 of the exemplary embodiment, the array of blastholes comprises at least two substantially vertical rows of blastholes. A first substantially vertical row of blastholes 26 and a second substantially vertical row of blastholes 28 extend substantially parallel to the free face 22. The blastholes are shown out of proportion in the figures for clarity of illustration, i.e., the diameter of the blastholes is actually much smaller in relation to the horizontal dimensions of the retort than shown.

The burden distance from the first substantially vertical row 26 of blastholes to the free face 22 is greater than the burden distance from the second substantially vertical row 28 of blastholes to a free face formed by the detonation of the explosive charges in the blastholes of the first row. The "burden distance" as used herein and described above is the substantially perpendicular distance from the center of mass of an explosive charge to the nearest free face toward which the unfragmented formation is to be explosively expanded. The burden distance of the second row of blastholes is, therefore, the distance from such a second row of blastholes to the first row of blastholes 26.

In an exemplary embodiment, the purposes of exposition, the width of the second portion 24 of formation to be explosively expanded is about 30 feet, the height of the formation to be explosively expanded is about 150 feet, and the width of the vertically extending void 20 is about 18 feet. A similar width of formation is explosively expanded towards the vertical void from the opposite side, hence the effective width of the void available for explosive expansion of the second portion 24 is about nine feet.

Explosive is placed into the blastholes of the first substantially vertical row 26 of blastholes for forming a first array of explosive charges 33. The first array of explosive charges is s substantially vertical row of line charges which is substantially parallel to the free face 22. The blastholes extend vertically substantially the entire height of unfragmented formation to be explosively expanded, i.e., the blastholes extend through the sill pillar 27 and through about the entire 150 foot height of the second portion 24 of unfragmented formation. Explosive is loaded into each blasthole substantially filling the bottom 150 feet of each blasthole which is extending through the second portion of formation. Several feet of stemming 31 are placed into each blasthole between the explosive charge 33 and the base of operation 25. Each explosive charge, therefore, extends as a column substantially the entire length of the unfragmented formation that is to be explosively expanded and such a first array of explosive charges has a first burden distance which is equal to the distance between the row of explosive charges 33 and the adjacent free face 22.

Explosive is placed into the blastholes of the second substantially vertical row 28 of blastholes for forming a second array of explosive charges 35. The second array of explosive charges is a substantially vertical row of line charges. Each explosive charge in the second row extends substantially the entire height of unfragmented formation to be explosively expanded, i.e., about 150 feet, and each explosive charge in the second row has a second burden distance equal to the distance between the two rows of charges.

The second burden distance is substantially less than the first burden distance; for example, in the exemplary embodiment, the burden distance of the second array of explosive charges 35 is about 10 feet and the burden distance of the first array of explosive charges 33 is about 20 feet.

It should be noted that in practicing principles of this invention, more than two arrays of explosive charges can be provided for explosive expansion of formation. When additional arrays of explosive charges are used in combination with the first and second arrays, the burden distance of each successive array more remote from the free face, such as the free face 22, is less than the burden distance of the next adjacent array closer to such a free face. For example, where first, second, and third arrays of explosive charges are used, the burden distance of the third array of explosive charges is less than the burden distance of the second array of explosive charges.

The second portion of formation can thereby be explosively expanded in layers. For example, the second portion 24 of formation has a first layer which is defined as the formation extending from a substantially vertical plane passing through the first array of explosive charges 33 to the free face 22 of the formation to be explosively expanded and such a first layer is designated **24*a* in the exemplary embodiment. The second portion 24 of formation also comprises a second layer extending from the plane passing vertically through the first array of explosive charges 33 to the side boundary 16 of the retort and such a second layer is designated 24*b*. The first and second layers of formation are substantially parallel to the free face toward which the formation is to be expanded and the first layer comprises a larger volume of formation than the second layer. In the exemplary embodiment, the first layer 24*a* contains about twice the volume of formation as does the second layer 24*b***.

When forming arrays of explosive charges in the second portion of formation, it is preferred that the equivalent scaled point charge depth of burial of each array of explosive charges be about equal to the equivalent scaled point charge depth of burial of each other array in such a second portion of formation. In the present embodiment, the equivalent scaled point charge depth of burial of the first array of explosive charges 33 is substantially equal to the equivalent scaled point charge depth of burial of the second array of explosive charges 35.

When the ratio of the weight of an explosive used in the first array of explosive charges to the volume of formation to be expanded by such first array of explosive charges is substantially equal to the ratio of the weight of such an explosive used in the second array of explosive charges to the volume of formation to be explosively expanded by the second array of explosive charges, the scaled point charge depth of burial of each array of explosive charges is substantially equal. This ratio is defined as the "powder factor" of an array of explosive charges. Having an equal powder factor results in using a first total energy of explosive for explosively expanding the first layer of formation and a second total energy of explosive for explosively expanding the second layer of formation, where the ratio of the first total energy of explosive to the volume of the first layer of formation is about equal to the ratio of the second total energy of explosive to the volume of the second layer of formation.

The scaled point charge depth of burial as it applies to cratering is described in a paper by Bruce B. Redpath entitled "Application of Cratering Characteristics to a Conventional Blast Design", a copy of which accompanies this application.

The scaled point charge depth of burial of an explosive charge can be expressed in units of distance over weight of explosive to the $\frac{1}{3}$ power or preferably distance over energy of explosive to the $\frac{1}{3}$ power. The distance, which is referred to as burden distance or actual depth of burial in the equation for scaled depth of burial, is measured from a free face of unfragmented formation toward which such unfragmented formation is to be explosively expanded to the center of mass of an explosive charge used for explosively expanding such unfragmented formation. The weight or energy of the explosive is the total weight or energy of the column of explosive.

A scaled point charge depth of burial can be defined for each explosive charge in each blasthole and, in addition, an equivalent scaled point charge depth of burial can be defined for an array of explosive charges.

The same effective scaled point charge depth of burial for an array such as a row, i.e., a 2-dimensional array of explosive charges, can be obtained with a variety of patterns of blastholes. For example, the scaled point charge depth of burial of an array of explosive charges can be altered by changing the amount of explosive in each blasthole, by changing the actual depth of burial of the explosive charge in each blasthole, by changing the diameter of each blasthole, by using a more or less energetic explosive in each blasthole, and by changing the array of blastholes so that the blastholes are spaced either closer or farther apart.

The scaled point charge depth of burial can be further understood by a study of the scaling law equations developed in the paper by Redpath. For example, the scaling law for an explosive point charge is well known and has been derived analytically and verified experimentally. This point charge relation can be written as:

$$sdob_{pt}=dob_{pt}/W^{\frac{1}{3}}$$

or $$dob_{pt}=sdob_{pt}\cdot W^{\frac{1}{3}} \quad (1)$$

where $dob_{pt}$=actual point charge depth of burial (in feet, for example);

$sdob_{pt}$=scaled point charge depth of burial (ft/lb$^{\frac{1}{3}}$);

W=charge weight (in pounds, for example).

A similar equation that can be written for a plane charge geometry appears as:

$$dob_{pl}=sdob_{pl}\cdot(W/s^2) \quad (2)$$

wherein pl denotes plane, and wherein the explosive charge is considered to form a substantially horizontal plane parallel to the free face and located in the unfragmented formation to be explosively expanded, and $W/s^2$ is the charge weight per unit area of such plane explosive charge. To ensure dimensional correctness, these relations show that:

$$sdob_{pt}=(l^3/w)^{\frac{1}{3}}$$

$$sdob_{pl}=(l^3/w)^1 \quad (3)$$

where l is a linear dimension and w is a charge weight. Note that $sdob_{pl}$ is the inverse of a powder factor (PF), where powder factor is the weight of an explosive charge per unit volume of formation explosively expanded as described hereinabove. In the above equation, the plane charge need not be continuous, but can consist of separate cylindrical charges in blastholes of a blasthole array such as a row or 2-dimensional array of blastholes as described hereinabove.

Point and plane charges will provide equivalent effects if they have the same powder factor or value of ($l^3$/w). From equation (3) this means that:

$$sdob_{pt}^3=sdob_{pl}. \quad (4)$$

The most useful equation in relating the scaled point charge depth of burial of explosive in each blasthole to the equivalent scaled point charge depth of burial of the array of explosive charges results when equation (4) is placed into equation (2) for providing:

$$dob_{pl}=sdob_{pt}^3\cdot(W/s^2) \quad (5)$$

which relates the scaled point charge dob, weight per unit area, and actual plane dob. Equation (5) can be used in two ways:

(a) Given a blast array using cylindrical explosive charges as described above, one can calculate directly ($W/s^2$), actual $dob_{pl}$, and the equivalent point charge $sdob_{pt}$ of the array of explosive charges using the relation $$sdob_{pt}=[dob_{pl}/(W/s^2)]^{\frac{1}{3}} \quad (6a)$$

(b) Given a scaled point charge dob that one wants to simulate using a row of blastholes having cylindrical explosive charges, one can first calculate $sdob_{pt}^3$ and then knowing the scale of the blasthole array that can be used (for example, the depth of blastholes, size of blastholes, and types of explosive to be used), calculation of $dob_{pl}$ and W, where W is the charge weight per hole can be completed. s then represents the required hole spacing between cylindrical explosive charges to simulate the equivalent point charge and can be calculated using the equation $$s=[W\cdot sdob_{pt}^3/dob_{pl}]^{\frac{1}{2}}. \quad (6b)$$

Where the spacing distance is less than the actual depth of burial or burden distance, the array will produce greater powder factor effects, such as finer breakage and higher surface velocities, than would an individual charge within the array. This effect can be attributed to a dynamic interaction and enhancement between the charges. If better mixing and higher bulking of the rubble is the desired product, it can be obtained by decreasing the scaled point charge depth of burial of each blasthole until it equals the equivalent scaled point charge depth of burial of the array of blastholes.

Where the spacing distance is greater than the actual charge depth of burial or burden distance, the array would appear to be deeper than the individual charges and would produce smaller powder factor effects than would an individual charge within the array.

Where the spacing distance is equal to the actual depth of burial or burden distance and the scaled point charge depth of each explosive charge in each blasthole is equal to the equivalent scaled point charge depth of burial of the array of explosive charges, the array would produce the same powder factor effects as would an individual charge within the array.

Referring again to FIGS. 1 and 2, the first substantially vertical row of blastholes 26 comprises four blastholes which are about 10 inches in diameter drilled into the second portion 24 of the formation. Each blasthole is filled with explosive up to the top boundary 14, i.e., the bottom of the sill pillar 27, for forming the first array of explosive charges 33 having a burden distance, i.e., actual depth of burial, of about 20 feet and a charge length of about 150 feet. In addition, the second substantially vertical row of blastholes 28 comprises seven blastholes about 5 inches in diameter drilled into the second portion 24 of formation. Each second blasthole is filled with explosive up to the top boundary 14 for forming the second array of explosive charges 35 having a burden distance or actual depth of burial of about 10 feet and a charge length of about 150 feet. Stemming 31 is placed above the explosive charge in each blasthole of both the first and second rows of blastholes.

The volume of formation to be explosively expanded by the second array of explosive charges 35 is about half the volume of formation to be explosively expanded by the first array of explosive charges 33. The total energy of the explosive charges used for explosively expanding the second layer **24*b* of formation is about half that of the total energy of the explosive used for explosively expanding the first layer 24*a*** of formation. The ratio, therefore, of total explosive energy to volume of formation to be explosively expanded is about equal for the first and second arrays of explosive charges. The scaled point charge depth of burial of the first array of explosive charges can be shown to be about equal to the scaled point charge depth of burial of the second array of explosive charges for this case as shown by equation (3).

To increase or maximize the mixing and rotation of particles for a given amount of explosive used in an explosive expansion of formation to give a higher void fraction or bulking factor, it is believed that the scaled point charge depth of burial of each charge in an array of charges should be made about equal to the equivalent scaled point charge depth of burial of the array of explosive charges as described hereinabove.

The scaling equations developed in the paper by Redpath show that the scaled point charge depth of burial of an individual explosive charge is about equal to the equivalent scaled point charge depth of burial of a row of explosive charges when the spacing distance is about equal to the burden distance or actual depth of burial. The spacing distance as described hereinabove is the distance between adjacent explosive charges in a row of blastholes.

To optimize mixing and rotation of particles for a given amount of explosive, the first array of explosive charges 33 is formed having a first spacing distance of about 20 feet. The first spacing distance is, therefore, about equal to the burden distance of the first array of explosive charges.

The second array of explosive charges 35 is formed having a second spacing distance of about 10 feet. The second spacing distance is, therefore, about equal to the burden distance of the second row of explosive charges and the second spacing distance is, therefore, less than the first spacing distance. It is preferred that the second spacing distance is less than the first spacing distance to enhance the powder distribution which increases the interaction of explosive charges of the second array of explosive charges 35.

Practice of principles of this invention is important for providing a fragmented permeable mass of formation particles having a reasonably uniform permeability for enhancing uniformity of gas flow through the retort. It is desirable to explosively expand the second layer 24*b* of formation toward the void 20 wherein such a second layer has less volume than the first layer 24*e* explosively expanded. Explosively expanding a second layer having less volume than the first layer is desirable because, when formation is explosively expanded toward a void, the first layer of formation explosively expanded has a larger void space toward which to expand than does the second layer. When the second layer is about equal in volume to the first layer, for example, the average void fraction of a fragmented mass of formation particles formed from such a first layer will be higher than the average void fraction of the fragmented permeable mass of formation particles formed from the second layer.

When practicing principles of this invention and explosively expanding a second layer of formation having less volume than a first layer of formation, a mass of formation particles is formed wherein the average void fraction and permeability of such a fragmented permeable mass of formation particles formed from the first layer is about equal to the average void fraction and permeability of such a fragmented mass of formation particles formed from the second layer. Having the average void fraction and permeabilities of the fragmented permeable masses of formation particles formed by each layer substantially equal enhances uniform gas flow through the retort, thereby improving the yield of gaseous and liquid products from the retort.

Figure 3:
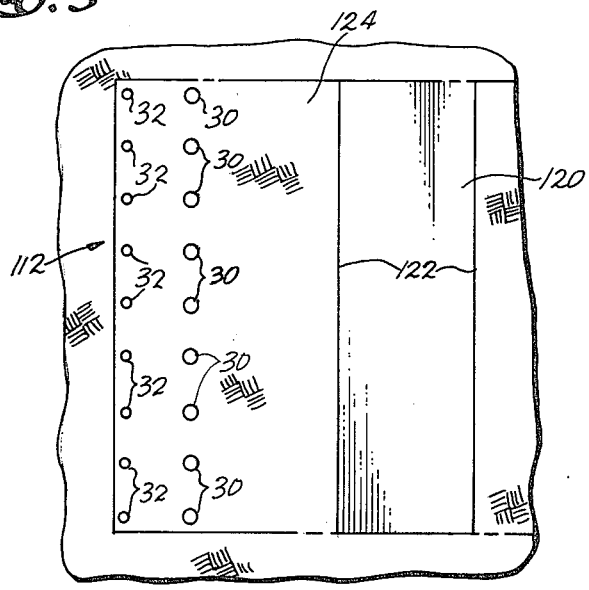
FIG. 3 is a semi-schematic horizontal cross-sectional view of a retort being formed similar to the retort of FIGS. 1 and 2 having another arrangement of blastholes.

Arrangements of explosive charges other than the arrangement of the embodiment described hereinabove can also be used in practicing principles of this invention. FIG. 3, for example, is a top view of a retort 112 being formed which is similar to, and hs the same dimensions as, the retort of FIGS. 1 and 2. FIG. 3 shows an exemplary embodiment used in practice of principles of this invention wherein the spacing distance is less than the burden distance. This results in the scaled point charge depth of burial of each individual charge being greater than the equivalent scaled point charge depth of burial of the array. Bulking, rotation, and mixing of formation particles can be controlled by varying the size of each individual explosive charge and by varying the distance between adjacent explosive charges in the array.

The retort 112 comprises a portion 124 of formation being prepared for explosive expansion toward a vertically extending void 120. Preferably, the void 120 is a limited void as described above. The retort 112 has an array of blastholes having a different configuration than the array of blastholes shown in FIGS. 1 and 2. The array of blastholes comprises a first substantially vertical row of blastholes 30 extending substantially parallel to a free face 122 and a second substantially vertical row of blastholes 32 extending substantially parallel to the free face 122.

In an exemplary embodiment, for purposes of exposition herein, explosive is placed into the blastholes of the substantially vertical first row of blastholes 30 for forming a first array of explosive charges having a burden distance of about 20 feet. Explosive is placed into the second substantially vertical row of blastholes 32 for forming a second array of explosive charges having a burden distance of about 10 feet. The first and second arrays of explosive charges are substantially vertical rows of line charges.

The blastholes of the first and second rows of blastholes are drilled through a sill pillar and through the entire thickness of the portion 124 of formation to be explosively expanded, as described hereinabove, for the embodiment shown in FIGS. 1 and 2. Explosive is placed into each of the blastholes for forming explosive charges having a charge length about equal to the thickness of the portion of formation to be explosively expanded. Stemming is placed into each blasthole between the explosive charge and the top of the sill pillar.

The blastholes of the first row of blastholes 30 have about the same spacing distance as the blastholes of the second row of blastholes 32. The hole diameter of each of the blastholes of the first row of blastholes is about equal. The hole diameter of each of the blastholes of the second row of blastholes is about equal and is smaller than the diameter of the blastholes in the first row.

It is preferred that the diameter of the blastholes of each row is selected for providing the first array of explosive charges having an equivalent scaled point charge depth of burial which is substantially equal to the equivalent scaled point charge depth of burial of the second array of explosive charges.

As discussed hereinabove, when the powder factor of the first array of explosive charges is equal to the powder factor of the second array of explosive charges, the equivalent scaled point charge depth of burial of the first array of explosive charges is about equal to the equivalent scaled point charge depth of burial of the second array of explosive charges.

The diameter of each blasthole in the first row of blastholes is about 10 inches and the volume of formation to be explosively expanded by the first array of explosive charges is about twice the volume of formation to be explosively expanded by the second array of explosive charges. The energy of explosive provided by the second array of explosive charges is preferred to be about half the energy provided by the first array of explosive charges. The diameter of each of the blastholes of the second row of blastholes is, therefore, about 7 inches.

As described hereinabove, for the embodiment shown in FIGS. 1 and 2, more than two arrays of explosive charges can also be used, if desired, for the embodiment which is shown in FIG. 3.

When more than two arrays of explosive charges are used in the present embodiment, the equivalent scaled point charge depth of burial of each successive array of explosive charges is preferably about equal to the equivalent scaled point charge depth of burial of each other array of explosive charges.

Although having the spacing of the second array of explosive charges about equal to the spacing of the first array of explosive charges does not enhance interaction between explosive charges of such a second array, this embodiment can be used for convenience in drilling or other like reasons.

Practice of principles of this invention can also be used for explosive expansion of formation toward a horizontal void or voids when forming an in situ oil shale retort using a horizontal free face system.

Figure 4:
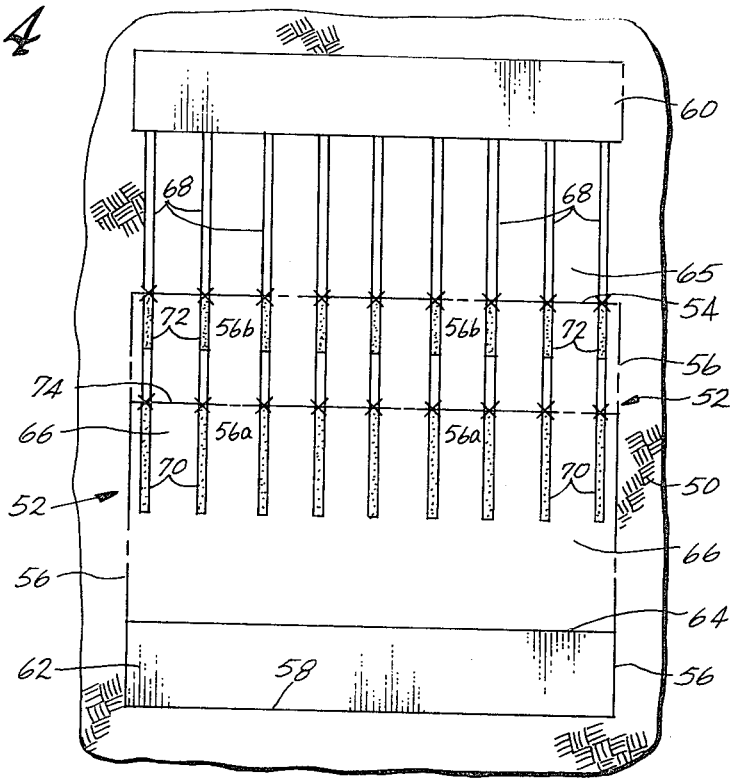
FIG. 4 is a semi-schematic vertical cross-sectional view of an in situ oil shale retort being formed using a horizontal void system.

FIG. 4 shows an arrangement of explosive charges that can be used in practicing principles of this invention for explosively expanding formation toward a horizontal void. FIG. 4 is a semi-schematic vertical cross-sectional view of an in situ oil shale retort being formed. For simplicity of illustration, in the exemplary embodiment, formation is prepared for explosive expansion toward one horizontally extending void. When forming a taller in situ oil shale retort, it may be desirable to excavate and explosively expand formation toward more than one void within the subterranean formation. When either one void is excavated or a plurality of voids are excavated within a subterranean formation, the explosive expansion of unfragmented formation can be downwardly toward an underlying void, upwardly toward an overlying void, or can involve zones of formation both above and below a void expanded simultaneously toward such a void. In addition, when more than one void is excavated in the formation, a zone of unfragmented formation can be expanded partly upwardly toward an overlying void and partly downwardly toward an underlying void.

In the exemplary embodiment, a subterranean formation 50 is shown having an in situ oil shale retort 52 being formed therein. The retort being formed has a top boundary 54, vertically extending side boundaries 56, and a bottom boundary 58 of unfragmented formation. The retort 52 is square or rectangular in horizontal cross-section. If desired, retorts having other horizontal cross-sections can also be formed.

Formation is excavated to form an upper level base of operation 60 above the top boundary 54. The upper level base of operation has a sufficient horizontal cross-section for providing effective access over substantially the entire horizontal cross-section of a fragmented permeable mass of formation particles being formed.

A first portion of formation is excavated from within the boundaries of the retort being formed to from at least one horizontal void 62. Preferably, the void 62 is a limited void, but, if desired, unlimited voids can also be used.

The void 62 provides at least one free face 64 extending horizontally through the oil shale formation within the boundaries of the retort 52 being formed. A second portion of the formation 66 is left within the boundaries of the retort being formed, extends away from the free face 64, and is to be explosively expanded toward the horizontally extending void 62. A sill pillar 65 of unfragmented formation extends between the top boundary 54 of the retort being formed and the floor of the base of operation 60.

Although one horizontally extending void such as the void 62 is used for clarity of illustration for forming the in situ oil shale retort of the exemplary embodiment, it should be understood that more than one horizontally extending void can be used if desired.

The void or voids excavated in a subterranean formation for forming an in situ oil shale retort preferably comprise more than about 15 percent and, more preferably, comprise from about 15 percent to about 45 percent of the total volume within the boundaries of the retort being formed.

Additional details of forming a horizontal void within a subterranean formation for forming an in situ oil shale retort can be found in U.S. Pat. No. 4,043,597 by Gordon B. French and in U.S. Pat. No. 4,043,598 to Gordon B. French et al. Both U.S. Pat. No. 4,043,597 and U.S. Pat. No. 4,043,598 are incorporated hereinabove by reference.

An array of substantially vertical spaced apart blastholes 68 is drilled into the second portion 66 of formation. The blastholes can be drilled from the base of operation downwardly through the sill pillar 65 and partway into the second portion 66 of formation. Alternatively, when no base of operation is provided, the blastholes can be drilled from the ground surface or from a drift or drifts adjacent the retort site. The array of blastholes is a substantially rectangular array where the spacing distance between blastholes is about equal. If desired, configurations of blastholes other than a rectangular array can be used. The array of blastholes covers substantially the entire horizontal cross-section of the retort being formed. Each of the blastholes 68 is loaded with explosive for providing a columnar explosive charge forming a substantially horizontal first array of explosive charges 70 and, in addition, each of the blastholes 68 also contains a columnar explosive charge forming a substantially horizontal second array of explosive charges 72. The first and second arrays of explosive charges extend across substantially the entire horizontal cross-section of the retort being formed.

The first array of explosive charges 70 has a first burden distance and the second array of explosive charges 72 has a second burden distance wherein the second burden distance is less than the first burden distance.

In an exemplary embodiment for purposes of exposition herein, the thickness of the second portion 66 of formation to be explosively expanded is about 60 feet and the height of the void toward which the second portion 66 of formation is to be explosively expanded is about 15 feet.

The second portion 66 of formation to be explosively expanded is expanded in two layers toward the void 62. The first layer of formation is about 40 feet thick and is designated 56*a;* the second layer of formation is about 20 feet thick and is designated 56*b*. The formation comprising both the first and second layers, after explosive expansion toward the void, comprises the fragmented permeable mass of formation particles in the in situ oil shale retort.

Alternatively, the layers can be expanded toward the void using a sub-level caving technique. When using a sub-level caving technique, the first layer is expanded toward the void, and then a portion of the formation thus expanded is withdrawn from the void, i.e., mucked out from the void, before the second layer is expanded.

The charge length of each charge in an array of explosive charges is preferred to be about one-half the thickness of unfragmented formation to be explosively expanded by such an explosive charge. The second layer 56*b* of formation to be explosively expanded is about 20 feet thick and, therefore, the charge length of each explosive charge in the second array of explosive charges is about 10 feet. Each explosive charge of the second array 72 of explosive charges extends from about the top boundary 54 about 10 feet into the second portion 66 of unfragmented formation.

The first array of explosive charges has a first burden distance and the second array of explosive charges has a second burden distance wherein it is preferred that the second burden distance is about half the first burden distance. For example, each explosive charge of the first array 70 of explosive charges extends about one-half the thickness of unfragmented formation to be explosively expanded by such a first array of explosive charges and each explosive charge is located in that portion of the unfragmented formation remote from the free face toward which such unfragmented formation is to be explosively expanded. Each explosive charge 70, therefore, extends about 20 feet from a substantially horizontal plane 74 which is substantially parallel to the free face 64 and is located about 20 feet from the top boundary 54 of the retort being formed. Each columnar explosive charge 70, therefore, has a charge length of about 20 feet and a burden distance or depth of burial of about 30 feet.

The explosive charges of the first and second arrays of explosive charges have detonators placed therein, wherein such detonators are designated by an "x". The explosive charges in both the first and second arrays of explosive charges are, for purposes of illustration, "bottom detonated", i.e., they are detonated at a point in the charge remote from the free face toward which the unfragmented formation is being explosively expanded.

The charge length of each explosive charge in the second array of explosive charges is about 10 feet, as described hereinabove, and the depth of burial or burden distance of each explosive charge is about 15 feet.

It is preferred that the equivalent scaled point charge depth of burial of the second array of explosive charges be substantially equal to the equivalent scaled point charge depth of burial of the first array of explosive charges.

This is accomplished when the ratio of the energy of explosive in the first array of explosive charges to the volume of formation to be explosively expanded by the first array of explosive charges is substantially equal to the ratio of the energy of explosive in the second array of explosive charges to the volume of unfragmented formation to be explosively expanded by the second row of explosive charges, as described hereinabove.

In the embodiment shown in FIG. 4, the volume of formation to be explosively expanded by the first array of explosive charges 70 is about twice the volume of formation to be explosively expanded by the second array of explosive charges 72.

The equivalent scaled point charge depth of burial is equal for the first and second arrays because the charge length of each charge in the first array of explosive charges is about twice that of the charge length of each charge in the second array of explosive charges and the diameter of each charge in the first array of explosive charges is equal to the diameter of each charge in the second array of explosive charges.

If desired, more than two arrays of explosive charges can be used. When more than two arrays of explosive charges are used, the equivalent scaled point charge depth of burial of each additional array of explosive charges is preferred to be equal to the equivalent scaled point charge depth of burial of each other array of explosive charges used for explosively expanding the second portion 66 of formation.

In an alternative arrangement of the exemplary embodiment, additional blastholes can be drilled into the second portion of formation for forming additional explosive charges in the second array of explosive charges. If desired, the additional blastholes can be drilled parallel to the blastholes in the first array 68 and on diagonals which connect the blastholes of the first array of blastholes shown in FIG. 4. When using additional blastholes as described in this embodiment, the spacing distance between explosive charges of the second array of explosive charges is less than the spacing distance between explosive charges of the first array of explosive charges. Having less spacing distance between explosive charges of the second array enhances the interaction between explosive charges of the second array, thereby enhancing the mixing and rotation of formation particles of unfragmented formation explosively expanded by such a second array. Additionally, having less spacing distance between explosive charges of the second array can maintain the ratio of spacing to burden the same for the formation to be explosively expanded by the first array of explosive charges and for the formation to be explosively expanded by the second array of explosive charges. Having the ratio of spacing to burden the same for both layers of formation results in a more uniform breakage for the two layers.

The size of the additional blastholes, and amount of explosive placed into such blastholes, is calculated by use of the scaling laws described in the paper by Redpath and described hereinabove.

Alternatively, if desired, the first array of explosive charges can be formed in a first array of blastholes and the second array of explosive charges can be formed in a second array of blastholes. The spacing distance between explosive charges of the second array can be different than the spacing distance between explosive charges of the first array. For example, it may be desirable, as described hereinabove, to form such a second array of explosive charges wherein the spacing distance between explosive charges of the second array is less than the spacing distance between explosive charges of the first array because the depth of burial of each explosive charge of the second array is less than the depth of burial of each explosive charge of the first array.

After the arrays of explosive charges are formed, as described above in the exemplary embodiments, the charges are detonated for explosively expanding the second portion of formation toward the void to form a fragmented mass of formation particles containing oil shale in the subterranean formation, thereby forming an in situ oil shale retort. The explosive charges are preferably detonated in a single round, but can be detonated in a plurality of separate rounds if desired.

Detonation in a single round, as used herein, means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

The detonation of explosive charges can be better understood by again referring to FIGS. 1 and 2. Initially, at least a portion of the first layer 24*a* of unfragmented formation is explosively expanded toward the void and thereafter the second layer 24*b* of unfragmented formation is explosively expanded toward the void. It is preferred that the explosive charges in the first array of explosive charges 33 are detonated in a single round for explosively expanding substantially the entire first layer of unfragmented formation toward the limited void, and thereafter the explosive charges of the second array 35 of explosive charges are preferably detonated in a single round for explosively expanding substantially the entire second layer of unfragmented formation toward the limited void.

When using a sub-level caving technique, a portion of the fragmented mass formed by explosively expanding the first layer can be withdrawn, i.e., mucked out from the void, before the second layer is expanded.

Although it is preferred that the explosive charges of the first array are detonated substantially simultaneously and thereafter the explosive charges of the second array are detonated substantially simultaneously, other detonation sequences can be used because of seismic shock or other like considerations.

One alternate detonation sequence that can be used comprises detonating in a single round at least one explosive charge in the first array of explosive charges 33 and, after a time delay sufficient for a new free face to form, detonating at least one explosive charge in the first array of explosive charges and at least one explosive charge in the second array of explosive charges 35 substantially simultaneously. The explosive charges of the second array that are detonated substantially simultaneously with explosive charges of the first array are adjacent a free face formed by a previous detonation of explosive of such a first array. For example, the explosive charge in the blasthole designated 26*a* can be detonated first. Thereafter, the explosive charge in the blasthole designated 26*b* of the first array and explosive charges in the blastholes designated 28*a* and 28*b* of the second array can be detonated substantially simultaneously.

In the exemplary embodiment described in FIG. 4, the layers of unfragmented formation can be explosively expanded separately. This can be accomplished by expanding the layers separately toward the void 62 in a single round or, if desired, the layers can be expanded toward the void 62 separately in separate rounds. For example, explosive charges comprising the first array of explosive charges can be detonated in a single round for expanding a first layer of unfragmented formation and thereafter, either in the same round or in a separate round, explosive charges comprising the second array of explosive charges can be detonated for expanding a second layer of unfragmented formation.

As described hereinabove, by practicing principles of this invention, an in situ oil shale retort is formed having a generally uniformly distributed void fraction having a fragmented mass of generally uniform permeability so that oxygen-supplying gas can flow relatively uniformly through such a fragmented mass during retorting operations.

Figure 5:
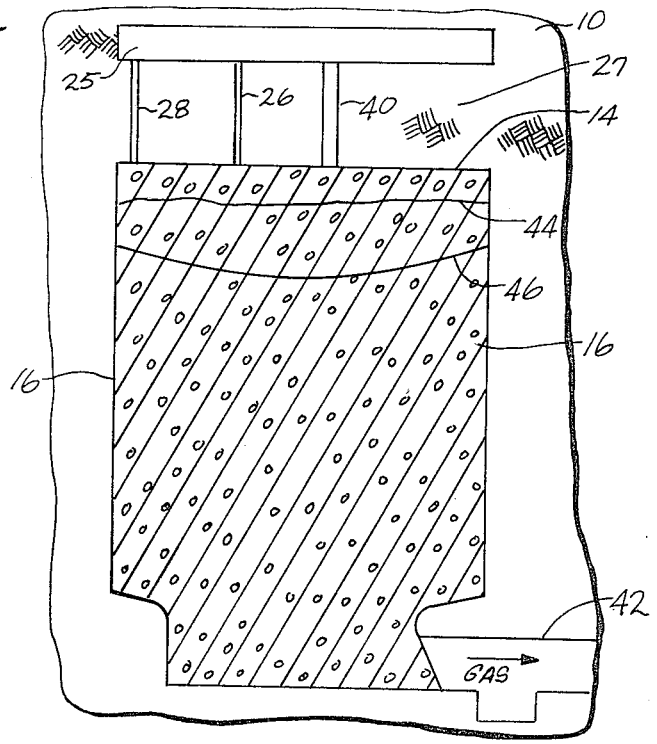
FIG. 5 is a semi-schematic vertical cross-sectional view of a retort formed using principles of this invention.

After having formed the fragmented permeable mass of oil shale particles in an oil shale retort as illustrated in FIG. 5, the final preparation steps for producing liquid and gaseous products from the retort are carried out. These steps include drilling at least one gas feed inlet passage 40 downwardly from the base of operation 25 to the top boundary 14 of unfragmented formations so that oxygen-supplying gas can be introduced into the fragmented mass during the retorting operations. Alternatively, at least a portion of blastholes drilled through the sill pillar 27 can be used for introduction of the oxygen-supplying gas. A separate substantially horizontal product withdrawal drift 42 extends away from the lower portion of the fragmented mass at the lower production level. The product withdrawal drift 42 is used for removal of liquid and gaseous products of retorting.

Although retorts being formed in these exemplary embodiments are described with a horizontal sill pillar of unfragmented formation left between the top of the fragmented mass and the overlying base of operation, it will be understood that variations can be practiced. Thus, for example, blastholes can be loaded with explosive to a level sufficient to also explosively expand formation toward an overlying base of operation. Such explosive expansion can be in the same round as expansion toward the vertical or horizontal voids, or can be in a subsequent round. In such an embodiment, a retort inlet mixture is introduced from an overlying or laterally adjacent drift.

Similarly, the retort can be formed without an overlying subterranean base of operation, with blastholes drilled from the ground surface.

During retorting operations, a combustion zone 44 is established in the fragmented permeable mass and the combustion zone is advanced downwardly through such fragmented mass by introduction of an oxygen-supplying gas into the retort. Combustion gas produced in the combustion zone passes through the fragmented mass to establish a retorting zone 46 on the advancing side of the combustion zone wherein kerogen in the oil shale is retorted to produce liquid and gaseous products of retorting. The liquid products and an off gas containing gaseous products pass to the bottom of the fragmented mass and are withdrawn from the product withdrawal shift.

A pump, not shown, is used to withdraw liquid products from the withdrawal drift to above ground. Off gas is withdrawn by a blower, not shown, and passed to above ground.

The above description of a method for recovering oil shale in a subterranean formation containing oil shale, including the description of preparing the in situ oil shale retort by explosive expansion is for illustrative purposes. Because of variations which will be apparent to those skilled in the art, the present invention is not intended to be limited to the particular embodiment described above. The scope of this invention is defined in the following claims.

What is claimed is:

1. A method for recovering liquid and gaseous products from an in situ oil shale retort in a subterranean formation containing oil shale comprising the steps of:

excavating a first portion of the formation from within the boundaries of the retort being formed to form at least one void, the surface of the formation defining such a void providing at least one free face within the boundaries of the retort being formed, and leaving a second portion of the formation within the boundaries of such retort being formed and extending away from such a free face, such a second portion to be explosively expanded toward such a void;

placing at least two arrays of explosive charges in such a second portion of formation, the first array of explosive charges having a first burden distance measured from such a free face and the second array of explosive charges having a second burden distance measured from the first array of explosive charges, the second burden distance being less than the first burden distance, wherein the equivalent scaled point charge depth of burial of the first array of explosive charges is substantially equal to the equivalent scaled point charge depth of burial of the second array of explosive charges, the first array of explosive charges being closer to the free face than the second array of explosive charges;

detonating such explosive charges for explosively expanding such a second portion of formation toward such a void to form a fragmented permeable mass of formation particles containing oil shale in the subterranean formation for forming an in situ oil shale retort;

introducing gas into the fragmented permeable mass in the in situ oil shale retort for establishing a retorting zone in the fragmented mass wherein oil shale is retorted to produce gaseous and liquid products and for advancing the retorting zone through the fragmented mass; and withdrawing gaseous and liquid products from the retort.

2. The method according to claim 1 wherein such a void is a limited void.

3. The method according to claim 1 wherein the explosive is detonated in a single round.

4. The method according to claim 1 wherein the first burden distance is about twice the second burden distance.

5. The method according to claim 1 wherein the spacing distance between explosive charges of the second array of explosive charges is less than the spacing distance between explosive charges of the first array of explosive charges.

6. The method according to claim 5 comprising:

forming the first array of explosive charges having a first ratio of spacing distance to burden distance and forming the second array of explosive charges having a second ratio of spacing distance to burden distance wherein the first ratio is about equal to the second ratio.

7. The method according to claim 6 comprising forming the first array of explosive charges having a first spacing distance wherein the first spacing distance is about equal to the first burden distance and forming the second array of explosive charges having a second spacing distance wherein the second spacing distance is about equal to the second burden distance.

8. The method according to claim 1 wherein such a void is a vertically extending limited void and such a free face extends vertically through the oil shale formation.

9. The method according to claim 8 comprising forming the arrays of explosive charges by:

forming an array of spaced apart blastholes in such a second portion of formation adjacent such a free face, the array comprising at least two substantially vertical rows of blastholes, each row extending substantially parallel to such a free face; and placing explosive into such blastholes forming the first and second arrays of explosive charges.

10. The method according to claim 1 wherein such a void is a horizontally extending limited void and such a free face extends horizontally through the oil shale formation.

11. The method according to claim 10 comprising forming the arrays of explosive charges by:

forming at least one array of spaced apart blastholes in such a second portion of formation, such an array comprising generally vertical blastholes, each blasthole substantially perpendicular to such a free face; and placing explosive into such blastholes forming the first and second arrays of explosive charges.

12. The method according to claim 1 comprising detonating explosive charges in such a first array of explosive charges substantially simultaneously and thereafter detonating explosive charges in such a second array of explosive charges substantially simultaneously.

13. The method according to claim 1 comprising detonating at least one explosive charge in the first array of explosive charges and thereafter detonating at least one explosive charge in the first array of explosive charges and at least one explosive charge in the second array of explosive charges substantially simultaneously, such explosive charge in the second array being adjacent to a free face formed by the detonation of an explosive charge in such first array.

14. A method for forming an in situ oil shale retort in a retort site within a subterranean formation containing oil shale, such an in situ oil shale retort containing a fragmented permeable mass of formation particles, such a fragmented mass having top, bottom, and side boundaries, comprising the steps of:

excavating a first portion of the formation from within the boundaries of the fragmented mass being formed to form at least one void, a surface of the formation defining such a void providing at least a first free face within the boundaries of the fragmented mass being formed, and leaving a second portion of the formation within the boundaries of such fragmented mass being formed and extending away from such first free face, such second portion to be explosively expanded toward such a void;

placing at least a first and a second array of spaced apart explosive charges in such a second portion of formation, the first array being closer to the first free face than the second array wherein the burden distance of the first array measured from the first free face is greater than the burden distance of the second array measured from the first array of explosive charges; and detonating such explosive charges for explosively expanding such a second portion of formation toward the void to form a fragmented permeable mass of formation particles containing oil shale in the subterranean formation for forming an in situ oil shale retort.

15. The method according to claim 14 wherein the equivalent scaled point charge depth of burial of the first array of explosive charges is substantially equal to the equivalent scaled point charge depth of burial of the second array of explosive charges.

16. The method according to claim 15 wherein the first array of explosive charges has a first ratio of spacing distance to burden distance and the second array of explosive charges has a second ratio of spacing distance to burden distance wherein the first ratio is about equal to the second ratio.

17. The method according to claim 16 wherein each explosive charge of the first array of explosive charges has a scaled point charge depth of burial about equal to the equivalent scaled point charge depth of burial of the first array of explosive charges and each explosive charge of the second array of explosive charges has a scaled point charge depth of burial about equal to the equivalent scaled point charge depth of burial of the second array of explosive charges.

18. The method according to claim 16 wherein the distance between adjacent explosive charges of the second array of explosive charges is less than the distance between adjacent explosive charges of the first array of explosive charges.

19. The method according to claim 16 wherein the distance between adjacent explosive charges of the first array of explosive charges is about equal to the burden distance of the first array of explosive charges and the distance between adjacent explosive charges of the second array of explosive charges is about equal to the burden distance of the second array of explosive charges.

20. The method according to claim 15 comprising detonating explosive charges in such a first array of explosive charges substantially simultaneously and thereafter detonating explosive charges in such a second array of explosive charges substantially simultaneously.

21. The method according to claim 15 comprising detonating at least a first explosive charge in the first array of explosive charges and thereafter detonating at least a second explosive charge in the first array of explosive charges and at least a first explosive charge in the second array of explosive charges substantially simultaneously, such first explosive charge in the second array being adjacent to a free face formed by the detonation of such first explosive charge in such first array.

22. A method for forming an in situ oil shale retort in a subterranean formation containing oil shale, such an in situ oil shale retort containing a fragmented mass of formation particles containing oil shale, comprising the steps of:

excavating a first portion of the formation from within the boundaries of the retort being formed to form at least one void, the surface of the formation defining such a void providing at least one free face within the boundaries of the retort being formed, and leaving a second portion of the formation within the boundaries of such retort being formed and extending away from such a free face, such second portion to be explosively expanded toward such a void;

placing at least two arrays of explosive charges in such a second portion of formation, the first array of explosive charges having a first burden distance measured from such a free face and the second array of explosive charges having a second burden distance measured from the first array of explosive charges, the second burden distance being less than the first burden distance, wherein the equivalent scaled point charge depth of burial of the first array of explosive charges is substantially equal to the equivalent scaled point charge depth of burial of the second array of explosive charges, the first array of explosive charges being closer to the free face than the second array of explosive charges; and detonating such explosive charges for explosively expanding such a second portion of formation toward such a void to form a fragmented permeable mass of formation particles containing oil shale in the subterranean formation for forming an in situ oil shale retort.

23. The method according to claim 22 wherein the first burden distance is about twice the second burden distance.

24. The method according to claim 22 wherein the spacing distance between explosive charges of the second array of explosive charges is less than the spacing distance between explosive charges of the first array of explosive charges.

25. The method according to claim 24 comprising:

forming the first array of explosive charges having a first ratio of spacing distance to burden distance and forming the second array of explosive charges having a second ratio of spacing distance to burden distance wherein the first ratio is about equal to the second ratio.

26. The method according to claim 25 comprising forming the first array of explosive charges having a first spacing distance wherein the first spacing distance is about equal to the first burden distance and forming the second array of explosive charges having a second spacing distance wherein the second spacing distance is about equal to the second burden distance.

27. The method according to claim 22 wherein such a void is a vertically extending void and such a free face extends vertically through the oil shale formation.

28. The method according to claim 27 comprising placing the at least two arrays of explosive charges in such a second portion of formation by:

forming at least two rows of spaced apart substantially vertical blastholes in such a second portion of formation, each row extending substantially parallel to such a free face; and placing explosive charges into such blastholes.

29. The method according to claim 22 wherein such a void is a horizontally extending void and such a free face extends horizontally through the oil shale formation.

30. The method according to claim 29 comprising forming the arrays of explosive charges by:

forming at least one array of spaced apart generally vertical blastholes in such a second portion of formation, each blasthole being substantially perpendicular to such a free face; and placing explosive charges into such blastholes.

31. The method according to claim 22 comprising detonating explosive charges in such a first array of explosive charges in a single round and thereafter detonating explosive charges in such a second array of explosive charges in a single round.

32. The method according to claim 22 comprising detonating at least a first explosive charge in the first array of explosive charges and thereafter detonating in a single round at least a second explosive charge in the first array of explosive charges and at least a first explosive charge in the second array of explosive charges, such first explosive charge in the second array being adjacent to a free face formed by the detonation of such first explosive charge in such first array.

33. A method for forming an in situ oil shale retort in a retort site within a subterranean formation containing oil shale, such an in situ oil shale retort containing a fragmented permeable mass of formation particles, such a fragmented mass having top, bottom, and side boundaries, comprising the steps of:

excavating a first portion of the formation from within the boundaries of the fragmented mass being formed to form at least one limited void, a surface of the formation defining such a void providing at least one free face within the boundaries of the fragmented mass being formed, and leaving a second portion of the formation within the boundaries of such fragmented mass being formed and extending away from such a free face, such second portion to be explosively expanded toward such a void;

forming an array of spaced apart blastholes in such a second portion of formation, the array comprising at least two rows of blastholes, wherein the burden distance of a first row of blastholes adjacent the void is greater than the burden distance of a second row of blastholes more remote from the void than such a first row;

placing explosive charges into blastholes of at least the first and second row of blastholes for forming a first array of explosive charges and a second array of explosive charges; and detonating such explosive charges for explosively expanding such a second portion of formation toward the void to form a fragmented permeable mass of formation particles containing oil shale in the subterranean formation for forming an in situ oil shale retort.

34. The method according to claim 33 comprising detonating such explosive charges in a single round.

35. The method according to claim 34 wherein the equivalent scaled point charge depth of burial of the first array of explosive charges is substantially equal to the equivalent scaled point charge depth of burial of the second array of explosive charges.

36. The method according to claim 35 comprising forming the first array of explosive charges having a first ratio of spacing distance to burden distance and forming the second array of explosive charges having a second ratio of spacing distance to burden distance wherein the first ratio is about equal to the second ratio.

37. The method according to claim 36 comprising forming each explosive charge of the first array of explosive charges having a scaled point charge depth of burial equal to the equivalent scaled point charge depth of burial of such first array of explosive charges and forming each explosive charge of the second array of explosive charges having a scaled point charge depth of burial equal to the equivalent scaled point charge depth of burial of such second array of explosive charges.

38. The method according to claim 36 wherein the spacing distance between explosive charges of the second array of explosive charges is less than the spacing distance between explosive charges of the first array of explosive charges.

39. The method according to claim 38 comprising forming the first row of blastholes having a first spacing distance wherein the first spacing distance is equal to the burden distance of the first array of explosive charges and forming the second row of blastholes having a second spacing distance wherein the second spacing distance is about equal to the burden distance of the second array of explosive charges.

40. The method according to claim 34 comprising detonating explosive charges in such a first array of explosive charges substantially simultaneously and thereafter detonating explosive charges in such a second array of explosive charges substantially simultaneously.

41. The method according to claim 34 comprising detonating at least one explosive charge in the first array of explosive charges and thereafter detonating at least one explosive charge in the first array of explosive charges and at least one explosive charge in the second array of explosive charges substantially simultaneously, such explosive charge in the second array being adjacent to a free face formed by the detonation of an explosive charge in such first array.

42. A method of explosively expanding formation toward a void comprising the steps of:

excavating a first portion of the formation to form a void, the surface of the formation defining such a void providing at least one free face extending through the formation and leaving a second portion of the formation which is to be explosively expanded toward such a void, extending away from such a free face;

placing at least two arrays of spaced apart explosive charges in such a second portion of formation, the first array being closer to the free face than the second array, wherein the burden distance of the first array is greater than the burden distance of the second array, the equivalent scaled point charge depth of burial of the first array of explosive charges being substantially equal to the equivalent scaled point charge depth of burial of the second array of explosive charges, the ratio of spacing distance to burden distance of the first array of explosive charges being about equal to the ratio of spacing distance to burden distance of the second array of explosive charges; and detonating the explosive charges for explosively expanding such a second portion of formation toward the void.

43. The method according to claim 42 comprising detonating explosive charges in such a first array of explosive charges in a single round and thereafter detonating explosive charges in such a second array of explosive charges in a single round.

44. The method according to claim 42 comprising detonating at least a first explosive charge in the first array of explosive charges and thereafter detonating in a single round at least a second explosive charge in the first array of explosive charges and at least a first explosive charge in the second array of explosive charges, such first explosive charge in the second array being adjacent to a free face formed by the detonation of such first explosive charge in such first array.

45. A method of explosively expanding formation toward a void comprising the steps of:

excavating a first portion of the formation to form a void, the surface of the formation defining such a void providing at least one free face extending throuh the formation and leaving a second portion of the formation extending away from such a free face, which second portion is to be explosively expanded toward such a void;

placing at least two arrays of spaced apart explosive charges in such a second portion of formation, wherein each explosive charge of the first array of explosive charges has a scaled point charge depth of burial about equal to the equivalent scaled point charge depth of burial of such first array of explosive charges and each explosive charge of the second array of explosive charges has a scaled point charge depth of burial about equal to the equivalent scaled point charge depth of burial of the second array of explosive charges; and detonating the explosive charges for explosively expanding such a second portion of formation toward the void.

46. The method according to claim 45 wherein the first array is closer to the free face than the second array and the burden of the first array is greater than the burden distance of the second array.

47. The method according to claim 45 wherein the equivalent scaled point charge depth of burial of the first array of explosive charges is substantially equal to the equivalent scaled point charge depth of burial of the second array of explosive charges.

48. A method of explosively expanding formation toward a limited void comprising the steps of:

excavating a first portion of the formation to form a limited void, the surface of the formation defining such a void providing at least one free face extending through the formation and leaving a second portion of the formation extending away from such a free face, which second portion is to be explosively expanded toward such a void;

forming at least one array of spaced apart blastholes in such a second portion of formation adjacent such a free face;

placing at least two arrays of explosive charges into such blastholes, wherein the burden distance of a first array of such explosive charges is greater than the burden distance of a second array of such explosive charges and the first array of such explosive charges is closer to the free face than the second array of such explosive charges; and detonating such explosive charges for explosively expanding such a second portion of formation toward the limited void.

49. The method according to claim 48 wherein the equivalent scaled point charge depth of burial of the first array of explosive charges is substantially equal to the equivalent scaled point charge depth of burial of the second array of explosive charges.

50. The method according to claim 48 wherein the ratio of spacing distance to burden distance of the first array of explosive charges is substantially equal to the ratio of the spacing distance to burden distance of the second array of explosive charges.

51. The method according to claim 48 wherein each explosive charge of the first array of explosive charges has a scaled point charge depth of burial about equal to the equivalent scaled point charge depth of burial of such first array of explosive charges.

52. The method according to claim 48 wherein each explosive charge of the second array of explosive charges has a scaled point charge depth of burial about equal to the equivalent scaled point charge depth of burial of the second array of explosive charges.

53. The method according to claim 48 comprising detonating explosive charges in such a first array of explosive charges in a single round and thereafter detonating explosive charges in such as second array of explosive charges in a single round.

54. The method according to claim 48 comprising detonating at least a first explosive charge in the first array of explosive charges and thereafter detonating in a single round at least a second explosive charge in the first array of explosive charges and at least a first explosive charge in the second array of explosive charges, such first explosive charge in the second array being adjacent to a free face formed by the detonation of such first explosive charge in such first array.

55. A method for forming an in situ oil shale retort in a retort site within a subterranean formation containing oil shale, such an in situ oil shale retort containing a fragmented permeable mass of formation particles, such a fragmented mass having top, bottom, and side boundaries, comprising the steps of:

excavating a first portion of the formation from within the boundaries of the fragmented mass being formed to form at least one vertically extending limited void, the surface of the formation defining such a void providing at least one free face extending vertically within the boundaries of the fragmented mass being formed, and leaving a second portion of the formation within the boundaries of such fragmented mass being formed and extending away from such a free face, such second portion to be explosively expanded toward such a void;

forming an array of spaced apart blastholes in such a second portion of formation adjacent such a free face, the array comprising at least two substantially vertical rows of blastholes, each row extending substantially parallel to such a free face, wherein the burden distance of a first row of blastholes is greater than the burden distance of a second row of blastholes and the spacing distance of the second row of blastholes is less than the spacing distance of the first row of blastholes and wherein the first row of blastholes is closer to the free face than the second row of blastholes;

placing explosive into blastholes of the first substantially vertical row of blastholes for forming a first array of explosive charges, and plaing explosive into blastholes of the second substantially vertical row of blastholes for forming a second array of explosive charges, the equivalent scaled point charge depth of burial of the first array of explosive charges being substantially equal to the equivalent scaled point charge depth of burial of the second array of explosive charges; and detonating such explosive charges in a single round for explosively expanding such a second portion of formation toward the void to form a fragmented permeable mass of formation particles containing oil shale in the subterranean formation forming an in situ oil shale retort.

56. The method according to claim 55 wherein the burden distance of the first row of blastholes is about twice the burden distance of the second row of blastholes.

57. The method according to claim 56 comprising forming the first array of explosive charges having a first ratio of spacing distance to burden distance and the second array of explosive charges having a second ratio of spacing distance to burden distance wherein the first ratio is about equal to the second ratio.

58. The method according to claim 55 comprising forming each explosive charge of the first array of explosive charges having a scaled point charge depth of burial equal to the equivalent scaled point charge depth of burial of such first array of explosive charges and forming each explosive charge of the second array of explosive charges having a scaled point charge depth of burial equal to the equivalent scaled point charge depth of burial of such second row of explosive charges.

59. A method of explosively expansing formation toward a void comprising the steps of:

excavating a first portion of the formation to form a void, the surface of the formation defining such a void providing at least one free face extending through the formation and leaving a second portion of the formation which is to be explosively expanded toward such a void extending away from such a free face;

placing explosive into such a second portion of formation;

detonating such explosive for explosively expanding such a second portion of formation toward the void, the second portion of formation comprising at least first and second layers of unfragmented formation, such first and second layers being substantially parallel to such a free face wherein the volume of the second layer of formation is less than the volume of the first layer of formation, the explosive expansion of the second portion of formation toward the void comprising the steps of:

initially expanding at least a portion of the first layer of unfragmented formation toward the void and thereafter expanding the second layer of unfragmented formation toward the void, wherein the equivalent scaled point charge depth of burial of the array of explosive charges used for explosively expanding the first layer of formation is about equal to the equivalent scaled point charge depth of burial of the array of explosive charges used for explosively expanding the second layer of formation.

60. The method according to claim 59 wherein the void is a limited void.

61. The method according to claim 59 wherein the void is a vertically extending limited void and the first layer comprise about twice the volume of formation as the second layer.

62. The method according to claim 59 wherein the explosive charges used for explosively expanding the second layer of unfragmented formation have less spacing distance than the explosive charges used for explosively expanding the first layer of formation.

63. The method according to claim 62 comprising explosively expanding substantially the entire first layer of unfragmented formation toward the void and thereafter explosively expanding substantially the entire second layer of unfragmented formation toward the void.

64. The method according to claim 59 comprising explosively expanding substantially the entire first layer of unfragmented formation toward the void and thereafter, in a separate round, explosively expanding substantially the entire second layer of unfragmented formation toward the void.

65. A method for forming an in situ oil shale retort in a retort site within a subterranean formation containing oil shale, such an in situ oil shale retort containing a fragmented permeable mass of formation particles, such a fragmented mass having top, bottom, and side boundaries, comprising the steps of:

excavating a first portion of the formation from within the boundaries of the fragmented mass being formed to form at least one void, the surface of the formation defining such a void providing at least one free face within the boundaries of the fragmented mass being formed, and leaving a second portion of the formation within the boundaries of such fragmented mass being formed and extending away from such a free face, such second portion to be explosively expanded toward such a void;

forming an array of spaced apart blastholes in such a second portion of formation adjacent such a free face, the array comprising at least two substantially vertical rows of blastholes, wherein the burden distance of a first row of blastholes is greater than the burden distance of a second row of blastholes and the spacing distance of the second row of blastholes is less than the spacing distance of the first row of blastholes, and wherein the first row of blastholes is closer to the free face than the second row of blastholes;

placing explosive into blastholes of the first substantially vertical row of blastholes for forming a first array of explosive charges, and placing explosive into blastholes of the second substantially vertical row of blastholes for forming a second array of explosive charges, the equivalent scaled point charge depth of burial of the first array of explosive charges being substantially equal to the equivalent scaled point charge depth of burial of the second array of explosive charges; and detonating such explosive charges for explosively expanding such a second portion of formation toward the void to form a fragmented permeable mass of formation particles containing oil shale in the subterranean formation forming an in situ oil shale retort.

66. The method according to claim 65 wherein the burden distance from the first row of blastholes is about twice the burden distance from the second row of blastholes.

67. The method according to claim 66 comprising forming the first array of explosive charges having a first ratio of spacing distance to burden distance and the second array of explosive charges having a second ratio of spacing distance to burden distance wherein the first ratio is about equal to the second ratio.

68. The method according to claim 65 comprising forming each explosive charge of the first array of explosive charges having a scaled point charge depth of burial equal to the equivalent scaled point charge depth of burial of such first array of explosive charges and forming each explosive charge of the second array of explosive charges having a scaled point charge depth of burial equal to the equivalent scaled point charge depth of burial of such second row of explosive charges.

69. A method of explosively expanding formation toward a limited void comprising the steps of:

excavating a first portion of the formation to form a limited void, the surface of the formation defining such a void providing at least one free face extending through the formation and leaving a second portion of the formation which is to be explosively expanded toward such a void extending away from such a free face;

placing explosive into such a second portion of formation; and detonating such explosive in a single round for explosively expanding such a second portion of formation toward the void, the second portion of formation comprising at least first and second layers of unfragmented formation, such first and second layers being substantially parallel to such a free face wherein the volume of the second layer of formation is less than the volume of the first layer of formation, the explosive expansion of the second portion of formation toward the void comprising the steps of:

initially expanding at least a portion of the first layer of unfragmented formation toward the void and thereafter expanding the second layer of unfragmented formation toward the void, wherein the equivalent scaled point charge depth of burial of the array of explosive charges used for explosively expanding the first layer of formation is about equal to the equivalent scaled point charge depth of burial of the array of explosive charges used for explosively expanding the second layer of formation.

70. The method according to claim 69 wherein the first layer comprises about twice the volume of formation as the second layer.

71. The method according to claim 69 wherein the explosive charges used for explosively expanding the second layer of unfragmented formation have less spacing distance than the explosive charges used for explosively expanding the first layer of formation.

72. The method according to claim 69 comprising explosively expanding substantially the entire first layer of unfragmented formation toward the limited void and thereafter explosively expanding substantially the entire second layer of unfragmented formation toward the limited void.

73. The method according to claim 72 comprising explosively expanding the first layer of formation using a first total energy of explosive and explosively expanding the second layer of formation using a second total energy of explosive wherein the ratio of the first total energy of explosive to the volume of the first layer of formation is about equal to the ratio of the second total energy of explosive to the volume of the second layer of formation.

74. A method for recovering liquid and gaseous products from an in situ oil shale retort in a subterranean formation containing oil shale, comprising the steps of:

excavating a first portion of the formation from within the boundaries of the fragmented mass being formed to form at least one void, a surface of the formation defining such a void providing at least a first free face within the boundaries of the fragmented mass being formed, and leaving a second portion of the formation within the boundaries of such fragmented mass being formed and extending away from such first free face, such second portion to be explosively expanded toward such a void;

placing at least a first and a second array of spaced apart explosive charges in such a second portion of formation, the first array being closer to the first free face than the second array, wherein the burden distance of the first array measured from the first free face is greater than the burden distance of the second array measured from the first array of explosive charges;

detonating such explosive charges for explosively expanding such a second portion of formation toward the void to form a fragmented permeable mass of formation particles containing oil shale in the subterranean formation for forming an in situ oil shale retort;

introducing gas into the fragmented permeable mass in the in situ oil shale retort for establishing a retorting zone in the fragmented mass wherein oil shale is retorted to produce gaseous and liquid products and for advancing the retorting zone through the fragmented mass; and withdrawing gaseous and liquid products from the retort.

75. The method according to claim 74 wherein the equivalent scaled point charge depth of burial of the first array of explosive charges is substantially equal to the equivalent scaled point charge depth of burial of the second array of explosive charges.

76. The method according to claim 75 wherein the first array of explosive charges has a first ratio of spacing distance to burden distance and the second array of explosive charges is a second ratio of spacing distance to burden distance, wherein the first ratio is about equal to the second ratio.

77. The method according to claim 76 wherein each explosive charge of the first array of explosive charges has a scaled point charge depth of burial about equal to the equivalent scaled point charge depth of burial of the first array of explosive charges and each explosive charge of the second array of explosive charges has a scaled point charge depth of burial about equal to the equivalent scaled point charge depth of burial of the second array of explosive charges.

78. The method according to claim 76 wherein the distance between adjacent explosive charges of the second array of explosive charges is less than the distance between adjacent explosive charges of the first array of explosive charges.

79. The method according to claim 76 wherein the distance between adjacent explosive charges of the first array of explosive charges is about equal to the burden distance of the first array of explosive charges and the distance between adjacent explosive charges of the second array of explosive charges is about equal to the burden distance of the second array of explosive charges.

80. The method according to claim 75 comprising detonating explosive charges in such first array of explosive charges substantially simultaneously and thereafter detonating explosive charges in such a second array of explosive charges substantially simultaneously.

81. The method according to claim 75 comprising detonating at least a first explosive charge in the first array of explosive charges and thereafter detonating at least a second explosive charge in the first array of explosive charges and at least a first explosive charge in the second array of explosive charges substantially simultaneously, such first explosive charge in the second array being adjacent to a free face formed by the detonation of such first explosive charge in such first array.

* * * * *

UNITED STATES PATENT AND TRADEMARK OFFICE

CERTIFICATE OF CORRECTION

PATENT NO. : 4,333,684

DATED : June 8, 1982

INVENTOR(S) : Thomas E. Ricketts et al

It is certified that error appears in the above—identified patent and that said Letters Patent is hereby corrected as shown below:

Col. 11, line 46, "e" should read -- a --;

Col. 12, line 9, "hs" should read -- has --;

Col. 25, line 8, "throuh" should read -- through --;

Col. 25, line 28, after "burden" and before "of", insert -- distance --;

Col. 26, line 12, "as" should read -- a --;

Col. 26, line 55, "plaing" should read -- placing --;

Col. 27, line 57, "comprise" should read -- comprises --;

Col. 30, line 30, "is" should read -- has --.

Signed and Sealed this

*Twenty-third* Day of *November 1982*

[SEAL]

*Attest:*

GERALD J. MOSSINGHOFF

*Attesting Officer*

*Commissioner of Patents and Trademarks*